US005870773A

United States Patent [19]

Smith

[11] Patent Number: 5,870,773

[45] Date of Patent: Feb. 16, 1999

[54] SNOWBOARDING WRIST PROTECTION DEVICE

[76] Inventor: Judson W. Smith, 1589 Campus Dr., Berkeley, Calif. 94708

[21] Appl. No.: 899,781

[22] Filed: Jul. 23, 1997

[51] Int. Cl.[6] ..... A41D 13/00

[52] U.S. Cl. ..... 2/16

[58] Field of Search ..... 2/16, 17, 21, 161.1, 2/159, 160; 280/821, 822

[56] References Cited

U.S. PATENT DOCUMENTS

| | | | |
|---|---|---|---|
| D. 246,612 | 12/1977 | Hosick . | |
| D. 279,025 | 5/1985 | Nordgren et al. . | |
| D. 279,026 | 5/1985 | Nordgren et al. . | |
| D. 340,497 | 10/1993 | Brewer . | |
| D. 343,218 | 1/1994 | Jarvinen . | |
| D. 355,229 | 2/1995 | Mugnolo . | |
| 4,285,530 | 8/1981 | Ducourant . | |
| 4,627,618 | 12/1986 | Schwartz . | |
| 4,645,235 | 2/1987 | Joseph | 280/821 |
| 4,657,282 | 4/1987 | Koch . | |
| 4,750,760 | 6/1988 | Gurley . | |
| 5,131,685 | 7/1992 | Dandy, III et al. | 280/821 |
| 5,135,455 | 8/1992 | King et al. . | |
| 5,288,106 | 2/1994 | Dorr . | |
| 5,290,063 | 3/1994 | Lenhart | 280/821 |
| 5,295,715 | 3/1994 | Van Blaricom | 280/821 |
| 5,312,135 | 5/1994 | Karabees . | |
| 5,549,329 | 8/1996 | Wuerslin et al. | 280/821 |
| 5,549,330 | 8/1996 | Wells | 280/822 |

*Primary Examiner*—Michael A. Neas

*Attorney, Agent, or Firm*—Pillsbury Madison & Sutro, LLP

[57] ABSTRACT

The snowboarding wrist protection device described contains a grip having a generally cylindrical body around which a snowboarder's hand clenches to make a fist. The forward edge of the grip may contain ridges and the back edge of the grip may be convex to aid the snowboarder in holding the protection device. Additionally, the top and bottom portions of the grip may extend outwardly from the hand held portion of the grip to further aid secure holding of the device. In the event of a fall, the snowboarder's hand remains clenched around the protection device. As such, the hands and fingers are precluded from being outstretched and are therefore not subject to reverse extension injury.

11 Claims, 2 Drawing Sheets

SNOWBOARDING WRIST PROTECTION DEVICE

FIELD OF THE INVENTION

The present invention relates to a hand held grip and more particularly to a grip held by a snowboarder to prevent finger, wrist and forearm-muscle injury.

BACKGROUND OF THE RELATED ART

Snowboarding is an increasingly popular sport in which snowboarders tend to hold their hands out for balance and on steep terrain to use their hands to judge distance from the uphill slope. Further, in the event of a fall, snowboarders instinctively, but dangerously, tend to extend their arms in an effort to break their fall with their palms open. As their hands contact the snow, the heel of the hand first breaks the surface causing the fingers and palm to be forced backward resulting in injury from reverse extension of the wrist and fingers, as well as from stretching muscles in the lower forearm.

In an attempt to reduce wrist injuries, snowboard gloves have incorporated support plates, as disclosed in U.S. Pat. No. 5,537,692, to restrict movement of the wrist and prevent reverse extension. This approach addressed one of the recognized injury hazards by supporting the snowboarder's wrist, but left the fingers unprotected and exposed to potentially greater injury from more concentrated forces. In the event of a fall, the heel of the extended snowboarder's hand would still contact the surface of the snow first. The support plates within the glove, however, would brace the wrist preventing it from bending backward, leaving only the unsupported fingers to absorb the force subjecting them to even worse injury.

SUMMARY OF THE INVENTION

It is therefore an object of the present invention to provide a snowboarding wrist protection device that prevents injury from reverse extension of the wrist and fingers as well as over stretching muscles of the lower forearm.

It is also an object of the present invention to provide a hollow inner chamber within the snowboarding wrist protection device that allows for the insertion of an item for safekeeping, such as a key or a fluid.

The snowboarding wrist protection device of the present invention protects a snowboarder's wrist, fingers and lower forearm muscles from injury in the event of a fall. The protection device contains a grip having a generally cylindrical body around which a snowboarder's hand clenches to make a fist. The forward edge of the grip may contain ridges and the back edge of the grip may be convex to aid the snowboarder in holding the protection device. Additionally, the top and bottom portions of the grip may extend outwardly from the hand held portion of the grip to further aid secure holding of the device. In the event of a fall, the snowboarder's hand remains clenched around the protection device. As such, the hands and fingers are precluded from being outstretched and are therefore not subject to reverse extension injury.

A retaining strap is connected to the top of the grip to prevent loss of the protection device. In addition, a tensioning mechanism is provided on the retaining strap so that the strap may be fit securely to the snowboarder's wrist, thus improving protection from loss. The bottom of the grip may be convex, allowing a snowboarder on steep terrain to brush the device along the ground for judging distance or providing support.

Further, the snowboarding wrist protection device of the present invention provides a detachable or screw-off cap that allows for access to a hollow inner chamber, which hollow inner chamber can then be used for the insertion of a user specified item, such as a key or a fluid.

BRIEF DESCRIPTION OF THE DRAWINGS

These and other objects, features and advantages of the present invention are better understood by reading the following detailed description of the preferred embodiment, taken in conjunction with the accompanying drawings, in which.

DETAILED DESCRIPTION OF THE PREFERRED EMBODIMENTS

Figure 1:
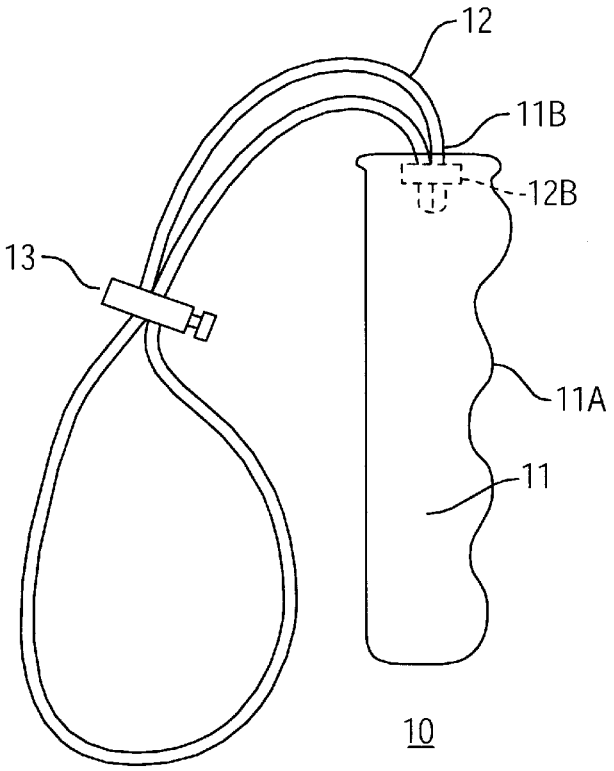
FIG. 1 is a perspective view of snowboard wrist protection device in accordance with a first embodiment of the present invention.

As shown in FIG. 1, a first embodiment of the snowboard wrist protection device 10 comprises a hand held grip 11 having a generally cylindrical body around which a snowboarder's hand is clasped. A grip 11 having any shape that allows a snowboarder's hand to clench around the grip is within the intended scope of the present invention. The grip 11 preferably has a front edge 11A which includes ridges that facilitate a more secure and comfortable hold on the grip. The grip is preferably manufactured of rubber, plastic or other similar weather resistant material that retains its shape.

An opening 11B at the top of the grip 11 permits insertion of the retaining strap 12 into the grip. The retaining strap is permanently affixed and held in place by a retaining strap securing means 12B. The securing means could include a knot at the end of the retaining strap, adhesive, or other means to hold the retaining strap permanently to the grip. The retaining strap is placed around the wrist of a snowboarder to prevent loss of the device. A strap adjustment mechanism 13 permits the retaining strap 12 to be securely adjusted about the snowboarder's wrist.

Figure 2A:
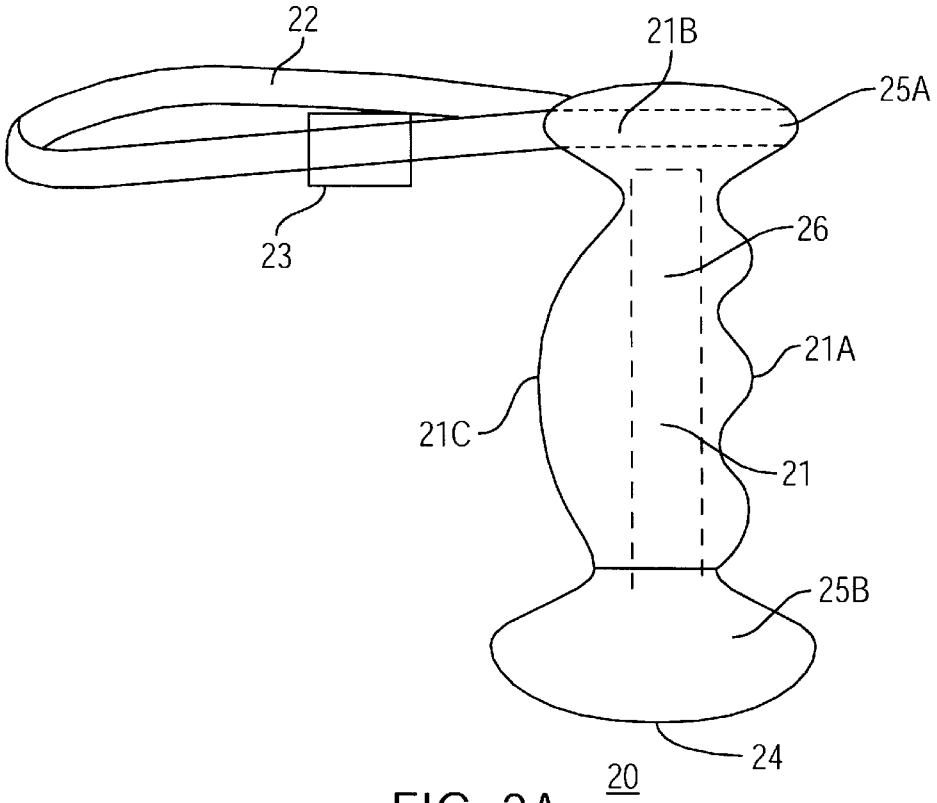
FIG. 2A is a perspective view of a snowboard wrist protection device in accordance with a second embodiment of the present invention.
Figure 2B:
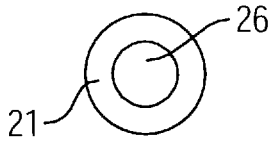
FIG. 2B is a cross section view of snowboard wrist protection device along view A—A of FIG. 2B in accordance with the second embodiment of the present invention.

A second embodiment of the present invention is shown in FIGS. 2A and 2B. Similarly to the first embodiment, a snowboard wrist protection device 20 comprises a hand held grip 21 having a generally cylindrical body. The front edge 21A of the grip contains ridges to accommodate a snowboarder's fingers and the back edge 21C of the grip is generally convex to accommodate the palm of the hand, thus providing a more securely held and comfortable grip. Further, the top portion 25A and bottom portion 25B of the grip 21 extend radially outwardly above and below, respectively, the hand held portion of the grip to provide an even more secure hold by a gloved snowboarder. The bottom 24 of the extended portion 25B of the grip 21 has a generally convex shape allowing a snowboarder to easily brush the bottom of the device along the ground while snowboarding to maintain a standoff position as well as balance.

A hole 21B in the top portion 25A of the grip permits a retaining strap 22 to be inserted into the grip. As with the first embodiment, a strap adjustment mechanism 23 permits the strap to be securely affixed around the snowboarder's wrist to prevent loss of the device.

Figure 2C:
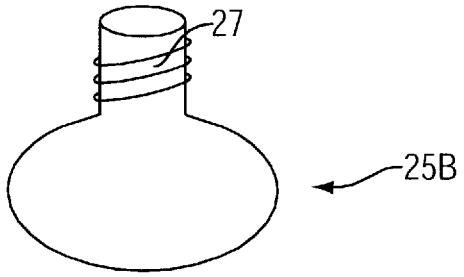
FIG. 2C illustrates a detachable cap that is used in accordance with the second embodiment of the present invention.

As also shown in FIGS. 2A–2C, the bottom portion 25B can be made as a detachable cap to provide access to a hollow chamber 26 that exists within the body of grip 21. The hollow chamber can be used to safely store an item, such as a key, or a fluid. Such a detachable bottom portion 25B is illustrated in FIG. 2C, with threads 27 thus cooperating with threads disposed in the hollow chamber. Rather than a screwably detachable bottom portion 25B as shown, a friction fit cap or other type of removable cap could be used as well to ensure that an item disposed in the hollow chamber 26 will not fall out. A detachable top cap, to which is connected the retaining strap 22, can also be implemented and has the advantage of not being lost as easily when the bottom portion 25B is detached from remainder of the grip 21.

In application, a user snowboarding down a hill holds a protection device in each hand with their fingers grasped around the grip. In the event of a fall, the snowboarder instinctively retains their grasp on the device. As a result, instead of attempting to break the fall with palms outstretched, risking wrist, finger and muscle injury, the use of the snowboard wrist protection device 10 inhibits the snowboarder's instinctive reaction to open the hands with the palms open to break the impact of the fall, and instead causes the clenched fists of the snowboarder to be retained, thereby causing the snowboarder to break the fall within his hands in a fisted condition. thus, with the hands in a fisted position when breaking the fall on the snow surface, reverse extension injury is avoided.

The foregoing specification sets forth the invention in its preferred, practical forms but the structure shown is capable of modification within a range of equivalents without departing from the invention which is to be understood is broadly novel as is commensurate with the appended claims.

I claim:

1. A method of preventing injury to the wrist, fingers and muscles of the lower forearm and hand caused by a fall of a snowboarder on a surface of snow comprising the steps of:

prior to the fall, grasping in each of a snowboarder's hands an individual snowboarding wrist protection device, said snowboarding wrist protection device comprising a grip having a shape allowing the snowboarder's hand to clench around the grip, and a retaining strap fixedly attached to a top portion of the grip for retaining the snowboarding wrist protection device to the snowboarder's wrist; and during and through the fall, as the snowboarder's outreached hands contact the surface of the snow, continuing to grasp each wrist protection device in each of the snowboarder's hands so that the hands of the snowboarder remain in clenched position and thus prevent injury from reverse extension of the snowboarder's hands.

2. The method of claim 1 wherein the snowboarding wrist protection device further comprises a strap adjustment mechanism for adjusting a length of the retaining strap and securely holding the snowboarding wrist protection device to the snowboarder's wrist.

3. A snowboarding wrist protection device for preventing wrist, finger and lower-forearm muscle injury caused by a fall while snowboarding, said snowboarding wrist protection device comprising:

a grip with a hollow chamber having a shape allowing a snowboarder's hand to clench around the grip;

a retaining strap fixedly attached to a top portion of the grip for retaining the protection device to a snowboarder's wrist; and a detachable cap that forms part of the grip and seals off said hollow chamber so that an item can be stored within the hollow chamber.

4. The snowboarding wrist protection device of claim 3 further comprising a strap adjustment mechanism for adjusting a length of the retaining strap and securely holding the protection device to the snowboarder's wrist.

5. The snowboarding wrist protection device of claim 3 wherein the grip shape is generally cylindrical.

6. The snowboarding wrist protection device of claim 5 wherein the grip has a front edge with ridges to accommodate a snowboarder's fingers.

7. The snowboarding wrist protection device of claim 6 wherein the grip has a back edge of convex shape to accommodate a snowboarder's palm.

8. The snowboarding wrist protection device of claim 7 wherein the top portion and a bottom portion of the grip extend above and below a hand-held portion of the grip respectively, and the top portion and the bottom portion of the grip extend radially outwardly.

9. The snowboarding wrist protection device of claim 8 wherein a bottom of the grip is generally convex.

10. The snowboarding wrist protection device of claim 3 wherein said detachable cap and said hollow chamber contain cooperating threads to seal of said hollow chamber.

11. The snowboarding wrist protection device of claim 3 wherein said retaining strap is attached to said detachable cap.

* * * * *